United States Patent [19]

Reaves et al.

[11] Patent Number: 4,648,216

[45] Date of Patent: Mar. 10, 1987

[54] PREFABRICATED BUILDING

[75] Inventors: Lloyd L. Reaves, Sioux Falls, S. Dak.; John K. Dawick, Miami, Fla.

[73] Assignee: Gang-Nail Systems Inc., Miami, Fla.

[21] Appl. No.: 517,333

[22] Filed: Jul. 26, 1983

[51] Int. Cl.[4] ..... E04B 1/32; E04C 3/02

[52] U.S. Cl. ..... 52/90; 52/639; 52/693; 52/DIG. 6

[58] Field of Search ..... 52/90–93, 52/639–643, 690–695, DIG. 6

[56] References Cited

U.S. PATENT DOCUMENTS

| | | | |
|---|---|---|---|
| 1,622,962 | 3/1927 | Michod | 52/693 X |
| 2,329,041 | 9/1943 | Ford | 52/639 |
| 2,644,204 | 7/1953 | Davis | 52/506 X |
| 2,856,646 | 10/1958 | Latimer et al. | 52/693 X |
| 3,332,196 | 4/1967 | Tuttle | 52/693 X |
| 3,352,070 | 11/1967 | Raynes | 52/693 X |
| 3,534,515 | 10/1970 | Beed | 52/693 X |
| 4,370,843 | 2/1983 | Menge | 52/693 |
| 4,435,929 | 3/1984 | Bussell | 52/DIG. 6 X |
| 4,483,117 | 11/1984 | Underhill et al. | 52/639 X |

FOREIGN PATENT DOCUMENTS

| | | | |
|---|---|---|---|
| 484192 | 6/1977 | Australia | 52/693 |
| 1085571 | 9/1980 | Canada | 52/639 |
| 979299 | 12/1950 | France | 52/90 |
| 1088144 | 3/1955 | France | 52/639 |

*Primary Examiner*—William F. Pate, III
*Assistant Examiner*—Richard E. Chilcot
*Attorney, Agent, or Firm*—Lowe, Price, LeBlanc, Becker & Shur

[57] ABSTRACT

A building constructed utilizing prefabricated wall frame structures, prefabricated roof truss structures and prefabricated purlin structures. In constructing the walls of the building, at least portions of the walls are constructed utilizing prefabricated braced frame structures. These braced frame structures can be interspersed with unbraced frame structures. Each of the braced frame structures has a plurality of lateral wooden frame members that interconnect two longitudinal wooden frame members and a built-in wooden frame cross-bracing member that extends in between the lateral wooden members. The wooden members of each of the frame structures are interconnected by metal connector plates. At least several of the purlin structures that are attached on top of the roof trusses have built-in cross-bracing. Each of the prefabricated braced purlin structures has a plurality of lateral wooden purlin members interconnecting two longitudinal wooden purlin members and a built-in wooden purlin cross-brace member extending between the lateral wooden purlin member. A plurality of metal connector plates interconnect the wooden members of the purlin structure. Each of the prefabricated roof truss structures is provided with at least a knee brace. This knee brace extends out from said roof truss structure in a V-shape formation for attachment to a longitudinal support column in such a manner as to distribute the forces created in the roof and purlin structure into the columns and truss joints, where the knee braces are connected to the columns.

34 Claims, 16 Drawing Figures

PREFABRICATED BUILDING

BACKGROUND OF THE INVENTION

The present invention relates to buildings constructed with prefabricated components and prefabricated components utilized in constructing such a building constructed with prefabricated components.

In order to decrease the cost while simultaneously increase the design reliability of building structures utilzing wooden construction frame members, attempts have been made to prefabricate various portions of building structures. For many years, prefabricated roof truss structures have been designed and for constructing numerous different types of buildings. Some attempts have been made at also prefabricating the side wall sections and purlin sections of wood-framed building structures. Such attempts, however, often have incurred various problems resulting in failures of the buildings constructed with different design approaches. While extensive work and design considerations have gone into the construction of roof trusses for light wood framed structures, such design efforts typically have not been carried over into the construction of the framed wall sections and purlin sections of the wood frame structures.

In an article in the September 1982 issue of Farm Building News entitled "Building Design Needs More Attention" numerous problems incurred with prior designs of light wood framed structures are set forth. Among the problems noted in such article are those discussed below. It is common in constructing such wood frame structures to provide a bottom chord member and webbed lateral bracing members that run perpendicular to the roof trusses but such structures are not provided with triangulating bracing for transmitting the loads to the exterior of the building and subsequently to the footings of the building. The purlin structures that commonly have been utilized often have been inadequate to withstand heavy loads such as created by drifts of snow or ice build-up on sections of the roof structure. The failure of the purlin structure, even a minor segment, can lead to excessive loads on the truss chord and buckling of the cord which can cause a spreading effect so as to create a partial or complete collapse of the building structure. The knee braces commonly utilized in such structures are designed to be attached only to the bottom chord of the trusses; such an attachment introduces secondary bending moments into the bottom chord which is not designed to withstand such loads. It has been recommended that the knee braces be installed within the truss scarf or extended to the truss top chord in order to resolve this particular problem.

Various patents have disclosed different designs for buildings constructed with prefabricated components and equipment for use in prefabricating sections for such a building constructed with prefabricated components. Exemplary of such patents are the following U.S. Patents: U.S. Pat. Nos. 3,156,018 to Slayter; 3,380,209 to Cheskin; 3,820,502 to Castillo et al.; 4,030,256 to Ollman; and, 4,069,627 to Pegg. The patent to Slayter shows a building structure that can be prefabricated in a plant in modular or segmented building sectins, each of which includes an integral construction of the roof, side walls and floor supports for the building section. The patent to Cheskin shows a prestressed framing system for use in building structures; in particular, the framing system is for use in constructing the floors of a building by interconnecting prestressed horizontal panel sections which are prestressed by utilizing a series of triangulating metal tension rods. The patent to Castillo et al. shows a system for prefabricating wooden building frames such as would be used in constructing wall frames for a building and shows the wall frames constructed with such system. The patent to Ollman discloses prefabricated units that can be used in constructing the roofs and walls of steel buildings. The patent to Pegg shows prefabricated sections for constructing a greenhouse wherein certain sections of both the roof panels and wall panels are braced by metal tension rods.

U.S. Pat. No. 4,044,093 to Jureit et al. discloses prefabricated flat chord truss assemblies such as assemblies that could be utilized either as floor supports or for constructing an arch over a doorway. U.S. Pat. No. 4,040,232 to Snow et al. discloses an elongated steel bracing member for bracing a wooden wall section of a light frame wooden structure in which the steel bracing member extends between top and bottom chord members and extends at an angle across a series of longitudinal wooden members with the steel bracing member being connected to the outer surface of the longitudinal members. U.S. Pat. No. 3,418,768 discloses load bearing wall sections which are reinforced by triangulating steel tension rods.

As previously discussed, extensive work has been done in the construction of prefabricated roof trusses. Exemplary of such prefabricated roof trusses are those shown in the following U.S. Patents: U.S. Pat Nos. 3,067,544 to Willatts; 3,785,108 to Satchell; and, Re. 31,234 to Jureit et al.

In addition, a typical prior art roof truss is shown in FIG. 13 of the present application and a typical prior art floor truss in FIG. 14 of the present application with major parts of such truss assemblies being labeled by appropriate common nomenclature.

SUMMARY OF THE INVENTION

An object of the present invention is to provide an improved prefabricated wooden frame building structure and prefabricated wooden components for constructing such a building structure.

Another object of the present invention is to provide a wooden frame building structure in which the frame for such structure can be constructed utilizing almost exclusively prefabricated wooden structural components.

A further object of the present invention is to provide an improved prefabricated wooden frame structure for a building structure which is capable of withstanding greater loads than prior wooden frame structures.

Still another object of the present invention is to provide an improved prefabricated agricultural wooden frame building structure.

Still a further object of the present invention is to provide an improved prefabricated wooden braced frame structure for use in constructing the walls of a wooden frame building structure.

A still further object of the present invention is to provide wooden braced purlin structures for use in constructing the roof of a wooden frame building structure.

Still another object of the present invention is to provide an improved roof truss structure having a knee brace at at least one end of such structure which knee brace is capable of distributing the forces generated within the roof truss structure so as to avoid excessive bending and any resulting failure of the roof truss.

The above objectives are accomplished in accordance with the construction of the building constructed with prefabricated components in accordance with the present invention. The building constructed with prefabricated components includes front, back and side wall structures. A plurality of prefabricated braced frame structures are used in constructing at least portions of the side walls. These brace frame structures form sections of the side walls and can be interspersed with unbraced frame structures. Each of the braced frame structures has a series of lateral wooden members that interconnect the two longitudinal side wooden members of the frame structure and a built-in cross-bracing member that extends between the lateral wooden members. Metal connector plates are used for interconnecting the various wooden members of the frame structure. A plurality of prefabricated roof truss structures are arranged on top of the walls and are equally spaced from each other so as to form the frame for the roof. A plurality of prefabricated purlin structures are arranged between and connected to the roof truss structures for forming the frame for the roof of the building. At least several of these purlin structures have a plurality of lateral wooden members that are interconnected between two longitudinal wooden members and a built-in wooden cross-bracing member that extends between said lateral wooden members. The wooden members of the purlin structure are interconnected by a plurality of metal connector plates.

The building constructed with prefabricated components structure of the present invention is particularly useful in constructing wooden frame structures for agricultural buildings. Depending on the loads to which such buildings will be subjected, the braced frame structures can be used in constructing only two walls of the building, preferably those walls to which the ends of the roof truss structures are attached, or if neceessary all four walls of the building. These brace frame structures can be interspersed with unbraced frame structures. If the building is expected to be subjected to very large loads, e.g. heavy loads created by high winds or heavy snow and ice conditions, then additional brace frame structures can be used for constructing the two sides of the building and if necessary can be used in constructing all four sides of the building.

The wooden cross-bracing member in the braced frame structures are constructed by a series of wooden sections that extend between the lateral frame members. Each of the wooden sections is interconnected with the next adjacent wooden section and the in between lateral frame member by a connector plate so that the wooden sections extend between the longitudinal frame members so as to form a cross-bracing member. Each of the wooden sections has one of its sides lying substantially within the same plane as a side of the lateral frame members so that the braced frame structure has a flat outer surface.

Preferably, each of the braced frame structures has two cross-bracing members. These two cross-bracing members extend in different directions for rigidly securing the braced frame structure so as to restrict any torsional movement in the lateral and longitudinal directions. By constructing the cross-bracing members with wooden sections that are arranged between the lateral members, so that the longitudinal ends of the wooden sections are actually in contact with the sides of the lateral members, the wooden sections themselves help in equalizing the distribution of forces throughout the structure and hence help to withstand compressive loads on the braced frame structures. These build-in cross-bracing members, therefore, significantly improve the ability of such structure to withstand various loads and forces exerted on the structure and the walls constructed with such structures. By interconnecting the wooden lateral, longitudinal and cross-bracing sections by the metal nail plates an essentially integral wooden structure braced in two directions can be prefabricated for use in constructing the sections of a prefabricated wooden frame building structure.

The wooden purlin cross-bracing member in the purlin structures also are constructed by a series of wooden sections that extend between the lateral wooden members of such purlin structures. Here again the adjacent wooden sections are interconnected with the respective lateral wooden member by metal connectors so as to form an integral braced purlin structure. The wooden sections lie between the lateral purlin members with the longitudinal ends of the wooden sections actually contacting the sides of the lateral members so as to help withstand compressive loads and improve the overall ability of the purlin structures to withstand various loads to which the roof of the building would be subjected.

It is preferable for each of the braced purlin structures to have at least two built-in cross-bracing members for bracing the purlin structure in different directions for rigidly securing the purlin structure against torsional movement in the lateral and longitudinal directions such as arising from wind forces and bucking due to compressive loads. In constructing the roof of the building structure, these brace purlin members can be interspersed with unbraced purlin members. Typically in constructing the roof of an agricultural building the roof trusses are spaced 8 feet apart and in accordance with the present invention these braced purlin structures would be used at least once within every 24 foot length of roof. However, if it is anticipated that the roof will be subjected to very heavy loads then additional braced purlin structures can be used in constructing the roof structure.

In forming the cross-bracing members in both the braced frame structures and the braced purlin structures, the first cross-bracing member extends from a top end of one of the longitudinal members to the middle section of a second of the longitudinal members and the second cross-bracing member extends from the middle section of the second longitudinal member to the bottom of the first longitudinal member. The wooden sections of the cross-bracing members are arranged edgewise with their narrow sides lying in the same plane as the outer surface of the lateral and longitudinal wooden members. If the same size wood, e.g. 2×4 inch wood, is utilizied for the lateral, longitudinal and cross-bracing sections then the constructed braced frame structures and braced purlin structures form integral units in which both the front and back surfaces of the structures are flat with the side edges of all of the wooden members lying in the same planes.

The prefabricated roof truss structure includes at least one integrally formed prefabricated knee brace at one end of the roof truss structure. Normally there would be two knee braces at both ends except in those situations where particular roof truss structures are arranged above a doorway. Since some of the roof truss structures have only one knee brace, each knee brace should be designed so as to be capable of sufficiently handling the loads expected to be placed on the structure with the expectation that the other end of the structure will have a typical single bearing point connection. Each of the knee braces extends in a V-shape formation out from the roof truss structure with both of the outer ends of the V-shaped knee brace being connected to a longitudinally extending wooden member connected to the walls of the building constructed with prefabricated components. The knee braces are connected to the longitudinally extending column members in such a manner so as to distribute the load forces generated at the ends of the respective roof trusses by the roof and purlin structure into the column and truss joints, where the knee braces are connected to the columns; this enables the truss/column structures to be capable of withstanding greater loads without any failure occurring at the area of connection between the roof trusses and the longitudinal support members.

The metal connectors that are utilized in constructing the various wooden members of each of the prefabricated components of the building constructed with prefabricated components of the present invention are preferably those metal connectors shown in commonly assigned U.S. Pat. No. 4,343,580 to Moyer et al. entitled "Structural Joint Connector." The subject matter of such patent is hereby incorporated by reference.

DESCRIPTION OF THE PREFERRED EMBODIMENT

Figure 1:
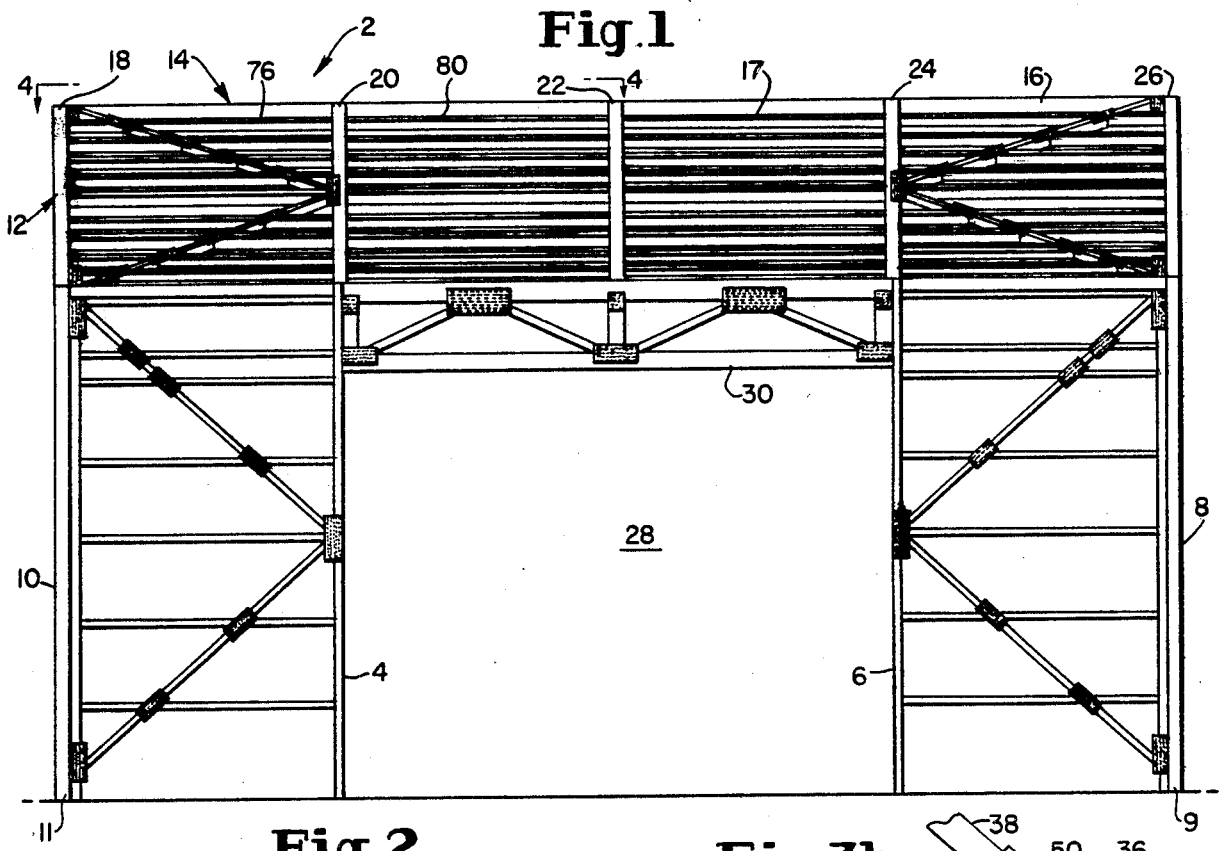
FIG. 1 is a front elevational view of a building constructed with prefabricated components constructed in accordance with the present invention.

A building 2 constructed with prefabricated components is shown in FIG. 1. The particular building illustrated and discussed herein is a building constructed for use as an agricultural building. Typically such buildings would come in standard sizes so that they could be built by utilizing standard preconstructed sections.

For example, the building illustrated in the figures has a width of 40 feet and a length of approximately 32 feet since it is built with 8 foot wide sections extending across the front and sides of the building. The span of the roof sections are 40 feet and the height of the building is approximately 25 feet from the foundation to the peak of the roof. The roof trusses are constructed using 2"×8" members for the top chords, 2"×6" members for the bottom chord and 2"×4" members for the internal web members. The wooden framing members used in constructing the prefabricated sections of the building are primarily 2"×4", 2"×6", 2"×8" and 2"×10" cross-sectional lumber. Where large loads are anticipated then the heavier lumber is used, particularly for the column supports. The building also would be provided with appropriate anchorage at each vertical support so as to enable the building to withstand loads of approximately in excess of 1100 lbs. horizontal wind load and in excess of 2000 lbs. wind uplift loads.

Figure 2:
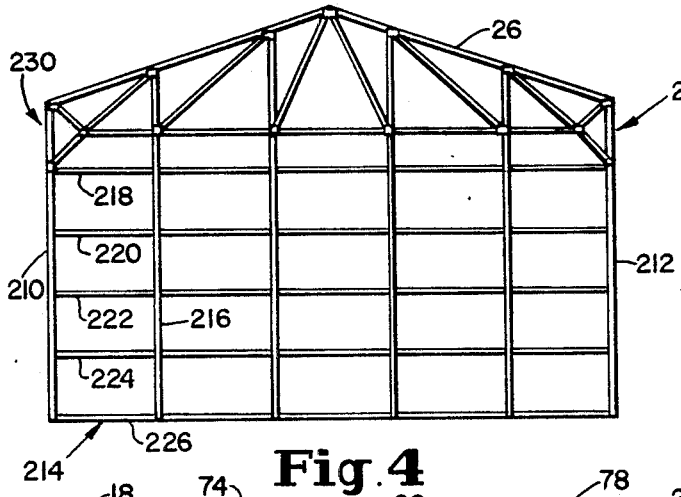
FIG. 2 is a side elevational view of a building constructed with prefabricated components constructed in accordance with the present invention.

In the building 2 constructed with prefabricated components shown in FIG. 1, the roof truss members are arranged perpendicular to the front and back walls of the building. The front side of the building constructed with prefabricated components 2 is shown in FIG. 1. At least the front and back walls are constructed utilizing side wall braced frame structures 4 and 6. Braced frame structures 4 and 6 are separated by a doorway 28 in the front wall of the building constructed with prefabricated components. In the rear wall of the building, where no doorway is present, the braced frame structures would be separated by two unbraced frame structures. Depending upon the load to which the building is expected to be subjected, the braced frame structures can be interspersed with unbraced frame structures. The number of braced frame structures and unbraced frame structures utilized in constructing the building would depend upon the overall length of the building and the forces to which the building is to be subjected. The higher the anticipated forces, both loads within the building as well as wind forces and loads created on the roof by snow and ice, the greater the number of braced frame structures that should be utilized in constructing the building. The side walls of the building are shown in FIG. 2. As seen in the particualr building illustrated in the drawings, the side walls of the building are constructed without the use of braced frame structures. However, if the building is to be subjected to heavier loads and forces then the braced frame structures also can be used in constructing the side walls of the building.

The braced frame structures are connected to additional longitudinal column support members such as wooden columns 8 and 10. The bottom ends 9 and 11 of column supports 8 and 10 are anchored to a foundation on the ground for securing the building to the ground. The roof 12 is mounted at the top end of the walls of the building constructed with prefabricated components. The peak 14 of building constructed with prefabricated components 2 extends longitudinally along the front of the buidling as shown in FIG. 1. A series of roof truss structures are arranged along the top of the building as shown by the sides of such structures 18, 20, 22, 24 and 26. Mounted between the roof truss structures are a series of braced purlin structures 16 and unbraced purlin structures 17.

Figure 12:
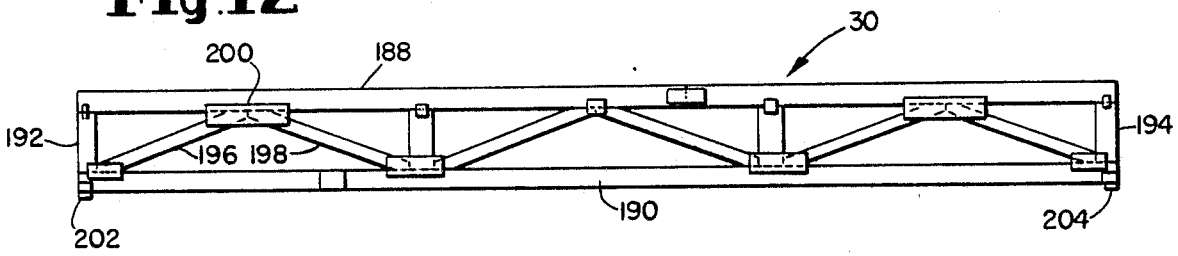
FIG. 12 is a flat truss support member that can be used in the building constructed with prefabricated components of the present invention.
Figure 13:
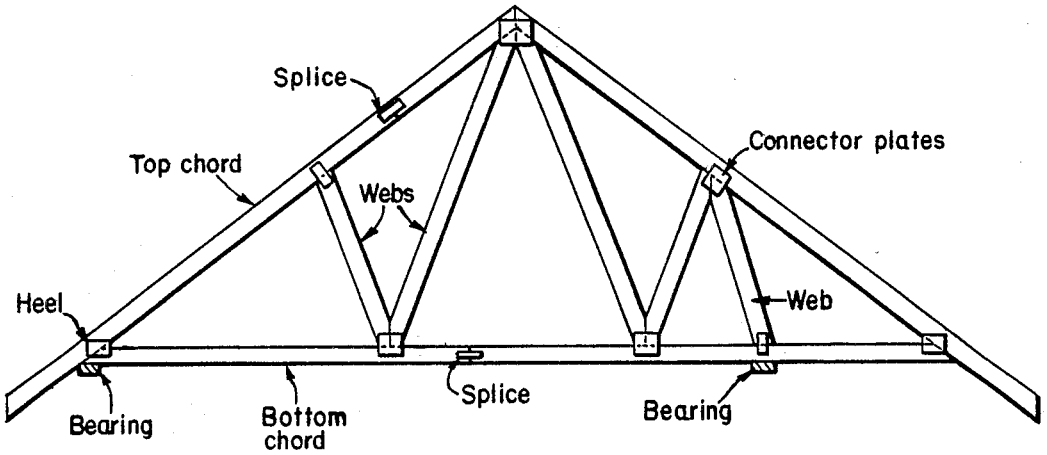
Fig. 13 PRIOR ART
FIG. 13 is a front elevational view of a prior art roof truss structure.
Figure 14:
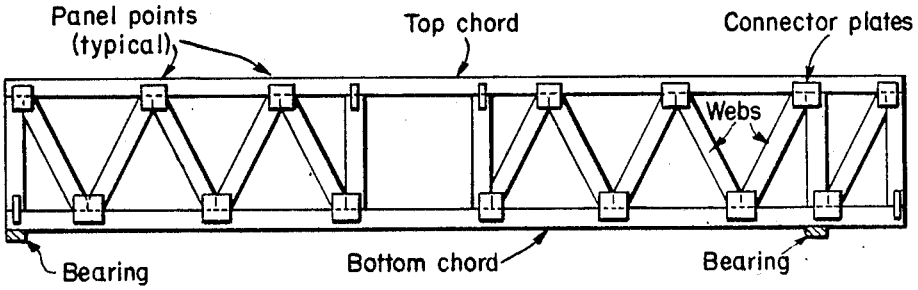
Fig. 14 PRIOR ART
FIG. 14 is a front elevational view of a prior art floor or flat truss structure.

The frame for the doorway 28 is made up by the longitudinal side frames of braced frame structures 4 and 6 and the joist structure 30 arranged above the top of the doorway. The length of joist structure 30 can be varied by splicing together additional longitudinal members and adding additional cross-bracing members such as shown in FIG. 12, discussed further below.

A side view of the building frame structure shown in FIG. 1 is shown in FIG. 2. This view is from the end of the building at which roof truss structure 26 is located. Roof truss structure 26 is mounted by its knee braces 230 and 232 to the top of vertical support columns 210 and 212. This side structure is constructed from a series of unbraced prefabricated frame structures such as frame structure 214. Structure 214 includes two longitudinal wooden members 210 and 216 and a series of lateral wooden members 218, 220, 222, 224 and 226 connected between the longitudinal members.

Figure 3B:
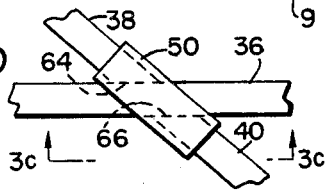
FIG. 3*b* is an enlarged front elevational view of one portion of the braced frame structure shown in FIG. 3*a*, such portion being the location of the interconnection of two of the wooden sections forming a portion of the cross-bracing member with the interspersed lateral member with the connector plate being shown by phantom lines.
Figure 3C:
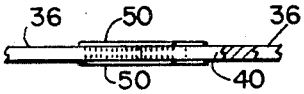
FIG. 3*c* is a side elevational view of a portion of the interconnected wooden members and connector plates shown in FIG. 3*b* taken along lines 3*c*–3*c*.
Figure 3A:
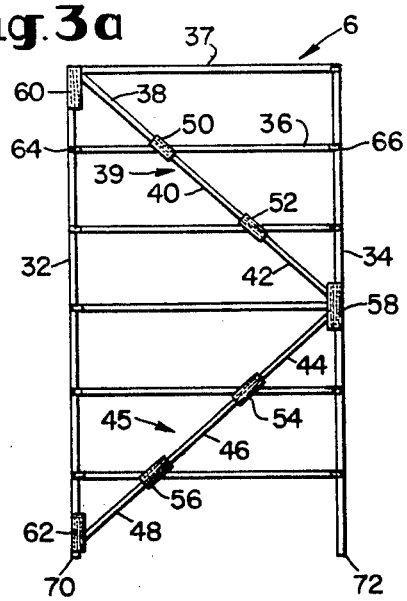
FIG. 3*a* is a front elevational view of a braced frame structure constructed in accordance with the present invention.

Each of the braced frame structures such as structure 6 shown in FIG. 3*a* is constructed with a plurality of lateral wooden members 36 arranged in parallel and connected to two longitudinal wooden members 32 and 34. While a lateral wooden member 37 is attached across the top of the frame structure, normally the bottom end of the structure would be free of any lateral member in order to enable legs 70 and 72 of longitudinal wooden member 32 and 34, respectively, to be attached to foundation support members. Braced frame structure 6 is provided with two cross-bracing members 39 and 45.

Cross-bracing member 39 in braced frame structure 6 is constructed using three wooden sections, 38, 40 and 42 which are connected together along with the lateral wooden members by connector plates 50 and 52. More specifically, such as shown in FIG. 3*b*, wooden section 38 is connected to adjacent wooden section 40 as well as the respective lateral wooden member 36 which lies between the two wooden sections by a connector plate 50. Wooden sections 38 and 40 are arranged so that their ends 64 and 66 abut the sides of lateral member 36. As shown in FIG. 3*c*, connector plates are arranged on both sides of the respective adjacent wooden sections and the respective lateral member. In this manner, an integral unit is formed and the wooden sections help to support the lateral members against compressive loads and to increase the rigidity of the entire frame structure 6. Frame structure 6 is also provided with a second cross-bracing member 45 that is constructed with three wooden sections 44, 46 and 48 which are connected together and connected with the respective lateral wooden members by connector plates 54 and 56. Thus, the cross-bracing members are built into the braced frame structure with the wooden sections being connected to and extending between the lateral members.

The lateral members of frame structure 6 are connected to longitudinal members 32 and 34 by a series of connector plates 64 and 66. In addition, the intersecting ends of cross-bracing members 39 and 45 are interconnected and connected to the middle section of longitudinal member 34 by a connector plate 58. The opposite end of cross-bracing member 39 is connected to the top end of longitudinal member 32 by connector plate 60 and the opposite end of cross-bracing member 45 is connected to the bottom end of longitudinal member 32 by a connector plate 62.

Figure 4:
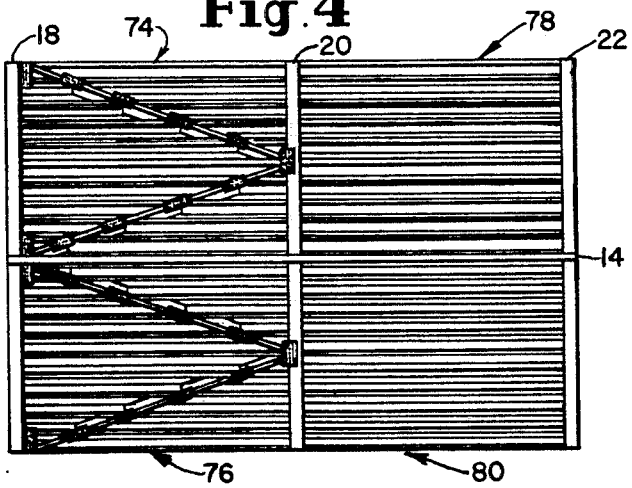
FIG. 4 is a top plan view of a portion of the roof structure of the building constructed with prefabricated components of the present invention.
Figure 5:
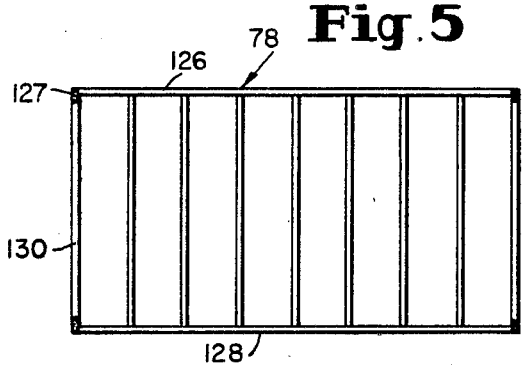
FIG. 5 is a top plan view of an unbraced purlin structure used in constructing the building constructed with prefabricated components of the present invention.
Figure 6:
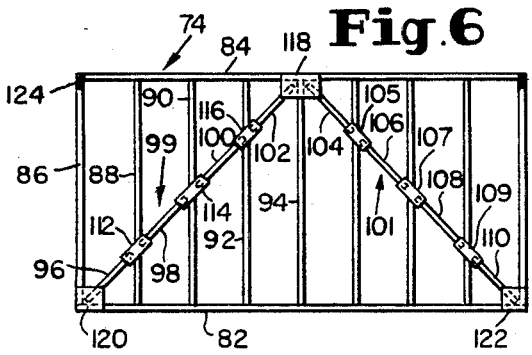
FIG. 6 is a top plan view of a braced purlin structure in accordance with the present invention.

Connected between the roof trusses such as trusses 18, 20 and 22 are a series of purlin frame structures such as braced purlin structures 74 and 76 and unbraced purlin structures 78 and 80, all of which are shown in FIG. 4. Unbraced purlin structure 78 is constructed by two longitudinal members 126 and 128 and a plurality of lateral members 130 connected between the two longitudinal wooden members. The lateral wooden members are connected to the longitudinal wooden members by a series of connector plates, only one of which, plate 127, has been shown for convenience.

Braced purlin structure 74 is constructed from two longitudinal wooden members 82 and 84 and a plurality of lateral wooden members such as members 86, 88, 90, 92 and 94 connected between the longitudinal wooden members. Connector plates, such as plate 124, are used for connecting the lateral wooden members to the longitudinal wooden members. Braced purlin structure 74 also includes two cross-bracing members 99 and 101. Each of these cross-bracing members is made up of a series of wooden sections interconnected by connector plates which also serve to connect the wooden sections to the respective lateral wooden members. Thus, cross-bracing member 99 is constructed from wooden sections 96, 98, 100 and 102 and connector plates 112, 114 and 116. These connector plates also are connected to the respective lateral wooden member that extends between the wooden sections. As discussed above with respect to the braced frame structure shown in FIG. 3*a* and the portions of such structure shown in FIGS. 3*b* and 3*c*, the ends of the wooden sections such as sections 96 and 98 lie in abutment with the sides of lateral wooden member 88 so that the wooden sections forming the cross-bracing members help to support the lateral members against compressive loads. Similarly, cross-bracing member 101 is constructed with a series of wooden sections 104, 106, 108 and 110 interconnected by connector plates 105, 107 and 109. The two adjacent ends of cross-bracing members 99 and 101 are connected to the middle section of longitudinal member 84 by connector plate 118. The opposite ends of cross-bracing members 99 and 101 are connected to longitudinal member 88 at its two outer ends by connector plates 120 and 122.

Consequently, both the braced frame structures and the braced purlin structures can be constructed in a prefabricating process. In constructing such structures, the wood used for all of the wooden members has the same cross-sectional dimensions and preferably all of the wood is arranged edgewise so that once the structures are interconnected by the connector plates the narrow edges of all of the wooden members on both sides of the wooden structures lie within the same planes.

Figure 7:
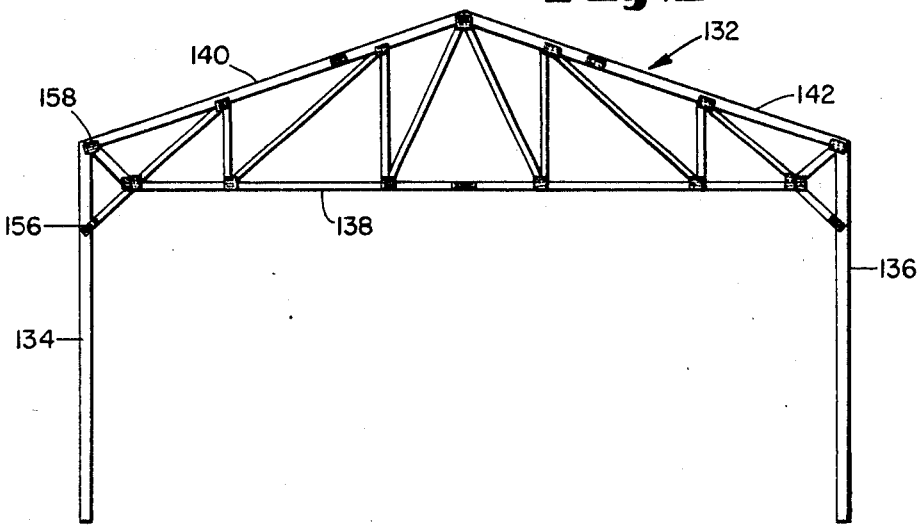
FIG. 7 is a front elevational view of a roof truss structure in accordance with the present invention attached to longitudinal wooden column support members.

In FIG. 7 one of the roof truss structures 132 is shown mounted on two column support members 134 and 136. Roof truss structure 132 has a bottom chord 138 and two top chords, 140 and 142. At each end of the roof truss structure is a knee brace, which has its ends connected to the column support at load bearing points 156 and 158.

Figure 8:
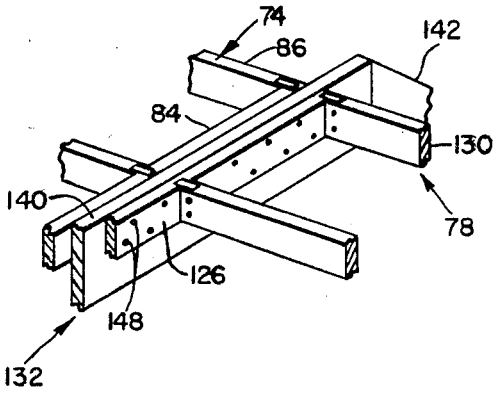
FIG. 8 is a perspective view of a portion of the roof structure of the building constructed with prefabricated components of the present invention showing the interconnection between the purlin structures and the roof truss structure.

The purlin structures are interconnected between the roof truss structures in the manner shown in FIG. 8. Portions of purlin structures 74 and 78 are shown in FIG. 8 attached to a top chord 140 of roof truss structure 132. The purlin is nailed by nails 148 to top chord 142 of the roof truss structure.

Figure 9:
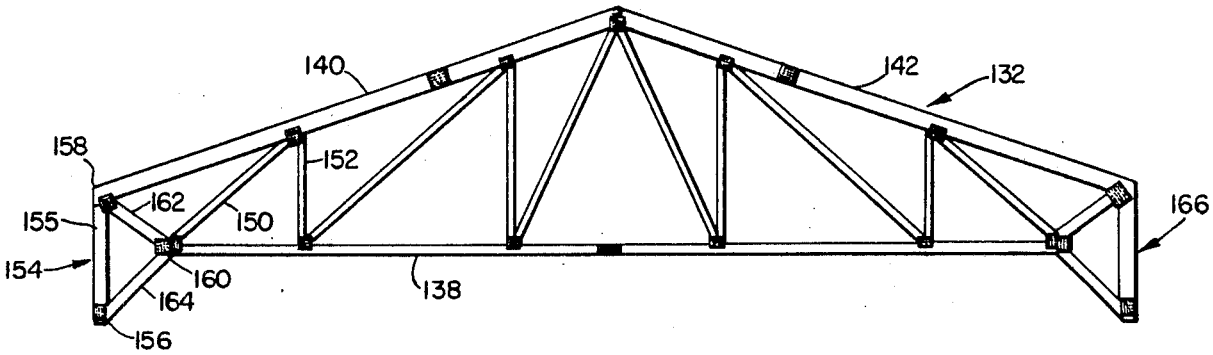
FIG. 9 is a front elevational view of a roof structure in accordance with the present invention with knee braces at both ends of the roof truss structure.
Figure 10:
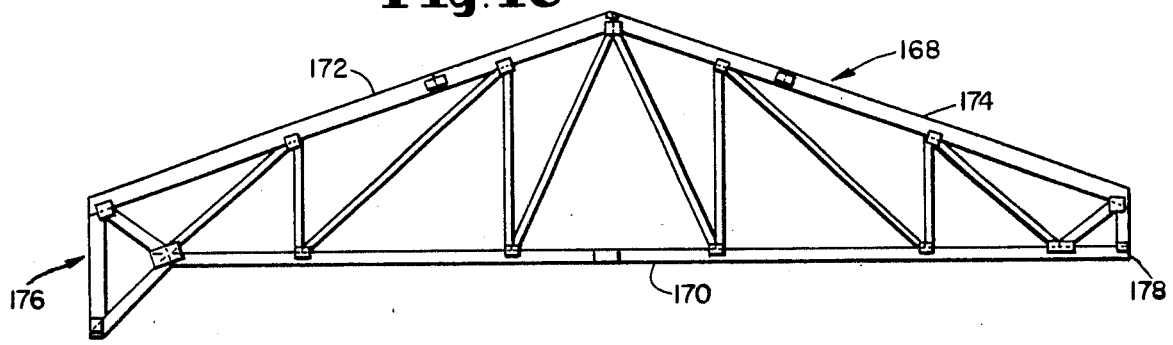
FIG. 10 is a front elevational view of an alternative embodiment of the roof truss structure in accordance with the present invention with a knee brace located at only one end of such structure.

Two alternative embodiments of the roof truss structures are shown in FIGS. 9 and 10. In the roof truss structure 132 shown in FIG. 9, the structure is provided with two knee braces 154 and 166. In the roof truss structure 168 shown in FIG. 10, the structure is provided with only one knee brace 176. Normally the roof truss structures would be provided with two knee braces except that at the location of the doorways such as doorway 28 as shown in FIG. 1, there is no column support member to which the center roof truss structure 22 can be attached. For this reason, a roof truss structure 168 would be used for truss 22 shown in FIG. 1 with only one knee brace being used for attaching the structure to a longitudinal column support at the rear of the building. Bearing point 178 of roof truss structure 168 would then rest upon the top of joist structure 30 which then acts as a bearing for that end of the roof truss structure.

Roof truss structure 132 has a bottom chord member 138 and two top chord members 140 and 142. The top chord members are provided with additional support by web members such as wooden members 150 and 152. Knee brace 154 is constructed by two wooden members 162 and 164 which extend out from an apex 160 to bearing points 156 and 158. The two wooden legs 162 and 164 of knee brace 154 are interconnected at apex 160 by a connector plate and the opposite ends of the legs are similarly attached to a vertical wooden support 155 at the opposite end of the knee brace from the apex 160. Similarly roof truss structure 168 is constructed with a bottom chord 170 and two top chords 172 and 174. Knee brace 176 of roof truss structure 168 is constructed in the same manner as knee brace 154 of roof truss structure 132.

Figure 11:
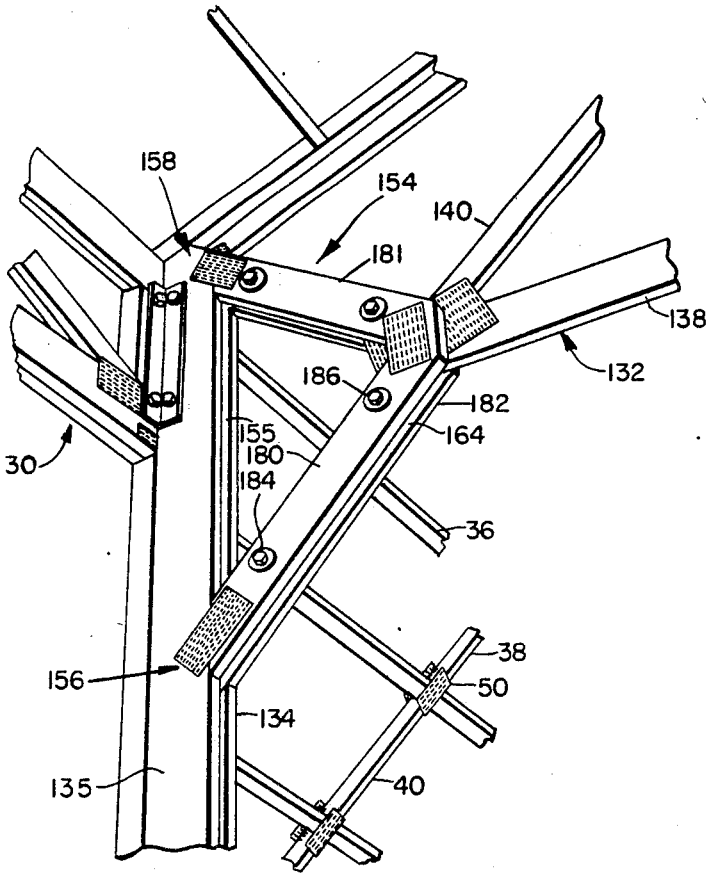
FIG. 11 is a partial perspective view showing the interconnection between the roof truss structure with the longitudinal column support member of the building constructed with prefabricated components of the present invention.

Each of the knee braces is attached to the longitudinal column support in the manner shown in FIG. 11. As illustrated in such figure, knee brace 154 of roof truss structure 132 is attached to column support 134 by a wooden clamping arrangement. The wooden clamp includes clamping legs that are mounted on both sides of knee brace legs 162 and 164. For example, clamping legs 180 and 182 are arranged on opposite sides of knee brace leg 164 and bolted to the knee brace leg 164 by bolts 184 and 186. The vertical support 155 of the knee brace leg is clamped between the longitudinal column supports 134 and 135 and also can be bolted to such column supports. The clamping members such as members 180 and 182 are attached to the respective column supports by connector plates and the top and bottom clamping members such as members 180 and 181 are connected by a connector plate. In this manner, the forces generated within the roof truss structure 132 are supported at two bearing points 156 and 158 so as to distribute the forces created in the roof and purlin structure in column supports 134 and 135 and truss joints 156 and 158, instead of all of the forces being concentrated at a single location.

A joist structure 30 which would serve as the top portion of the frame of a doorway 28 is shown in FIG. 12. This joist structure 30 has a top chord member 188 and a bottom chord member 190 with such chord members being connected at their ends by two transverse members 192 and 194. In addition a plurality of web members 196 and 198 are arranged for additional support in the interior of the joist structure 30. All of these wooden members are then interconnected by a series of connector plates such as plate 200. The bearing points for supporting joist structure 30 is at points 202 and 204.

In constructing the building constructed with prefabricated components shown in the figures as discussed above, various size connector plates have been utilized. All the connector plates, however, are constructed in accordance with the teachings of U.S. Pat. No. 4,343,580 to Moyer et al. The illustrated connector plates are all currently marketed by Gang-Nail Systems, Inc. under the mark "GNA 20" and are formed of 20 gauge steel.

The present invention may be embodied in other specific forms without departing from the spirit or essential characteristics thereof. The present embodiments are presented merely as illustrative and not restrictive, with the scope of the invention being indicated by the attached claims rather than the foregoing description. All changes which come within the meaning and range of equivalency of the claims are therefore intended to be embraced therein.

What is claimed is:

1. A building constructed with prefabricated components comprising:

front, back and side wall structures;

a plurality of prefabricated braced frame structures used in forming at least portions of said walls of said building constructed with prefabricated components, each of said braced frame structures having a series of lateral wooden frame members interconnecting two longitudinal wooden frame members and a built-in wooden frame cross-bracing member extending in between said lateral wooden frame members, and a plurality of metal connector plates interconnecting said wooden members, said connector plates having teeth struck out from such plates and embedded into said wooden members; said wooden frame cross-bracing member in said braced frame structures being constructed so as to be formed by a series of wooden sections extending between said lateral frame members with the ends of said wooden sections abutting the sides of the respective adjacent said lateral frame members and each of said wooden sections being interconnected with adjacent wooden sections and respective said lateral frame members by said metal connector plates so that said wooden sections form said frame cross-bracing member extending between said longitudinal frame members with each of said wooden sections having one of its sides lying substantially within the same plane as a side of said lateral frame members so as to provide said braced frame structure with a flat outer surface;

a plurality of prefabricated roof truss structures arranged on top of said walls and being approximately equally spaced from each other; and a plurality of prefabricated purlin structures arranged between and connected to said roof truss structures with at least several of said purlin frame structures having a plurality of lateral wooden purlin members interconnecting two longitudinal wooden purlin members and a built-in wooden purlin cross-bracing member extending in between said lateral wooden purlin members, and a plurality of metal connector plates interconnecting said wooden members, said connector plates having teeth struck out from such plates and embedded into said wooden members; said wooden purlin cross-bracing member in said purlin structures being constructed so as to be formed by a series of wooden sections extending between said lateral purlin members with the ends of said wooden sections abutting the sides of the respective adjacent said lateral purlin members and each of said wooden sections being interconnected with adjacent wooden sections and respective said lateral purlin members by metal connector plates so that said wooden sections form said purlin cross-bracing member extending between said longitudinal purlin members with said wooden sections having one of its sides lying in substantially the same plane as a side of said lateral purlin members so as to provide said purlin structure with a flat outer surface.

2. A building constructed with prefabricated components according to claim 1 wherein there are two said frame cross-bracing members built-into each of said braced frame structures and said two frame cross-bracing members extend in different directions for securing said braced frame structure against torsional movement in the lateral and longitudinal directions.

3. A building constructed with prefabricated components according to claim 2 wherein said two frame cross-bracing members include a first frame cross-bracing member extending from a top end of a first of said longitudinal frame members to the middle section of a second of said longitudinal frame members and a second frame cross-bracing member extending from said middle section of said second frame longitudinal member to the bottom end of said first frame longitudinal member.

4. A building constructed with prefabricated components according to claim 3 wherein said two frame cross-bracing members are interconnected to each other and said second longitudinal member by one of said metal connector plates.

5. A building constructed with prefabricated components according to claim 1 wherein there are two said purlin cross-bracing members built-into each of said purlin structures and said two purlin cross-bracing members extend in different directions for rigidly securing said purlin structure against movement in the lateral and longitudinal directions.

6. A building constructed with prefabricatd components according to claim 5 wherein said two purlin cross-bracing members include a first purlin cross-bracing member of each said purlin structure extending from a top end of a first of said longitudinal members to the middle section of a second of said longitudinal members and a second purlin cross-bracing members extending from said middle section of said second longitudinal member to the bottom end of said first longitudinal member.

7. A building constructed with prefabricated components according to claim 6 wherein said two purlin cross-bracing members are interconnected to each other and said second longitudinal member by one of said metal connector plates.

8. A building constructed with prefabricated components according to claim 1 wherein said braced frame structures only form portions of said walls of said building constructed with prefabricated components and further comprising: additional side panel structures interspersed between and used in conjunction with said braced frame structures for constructing said walls of said building constructed with prefabricated components and each of said additional side panel structures being constructed by a plurality of lateral wooden members connected between longitudinal wooden members by a plurality of metal connector plates.

9. A building constructed with prefabricated components according to claim 1 or 2 wherein said wooden sections of said frame cross-bracing members have the same cross-sectional dimensions as said frame lateral and longitudinal wooden members and said wooden sections and wooden members are arranged edgewise with their narrow sides lying in the same planes.

10. A building constructed with prefabricated components according to claim 1 wherein said wooden sections of said purlin cross-bracing members have the same cross-sectional dimensions as said purlin frame lateral and longitudinal wooden members and said wooden sections and wooden members are arranged edgewise with their narrow sides lying in the same planes.

11. A building constructed with prefabricated components according to claim 1 wherein each of said prefabricatd roof truss structures includes an integrally formed prefabricated knee brace at one end of said such roof truss structure.

12. A building constructed with prefabricated components according to claim 11 wherein said knee brace of each of said roof truss structures extends in a V-shape formation out from said roof truss structure with both outer ends of said V-shaped knee brace being connected to a longitudinally extending wooden member connected to said walls of said building constructed with prefabricated components.

13. A building constructed with prefabricated components according to claim 11 wherein each of said knee braces is connected to a longitudinally extending wooden member connected to said walls of said building constructed with prefabricated components and serves to distribute the load forces generated at the ends of the respective said roof truss structures into such longitudinally extending wooden members and joints where said knee braces are connected to such longitudinally extending wooden members so that said roof truss structures and corresponding longitudinally extending wooden members are capable of withstanding greater loads.

14. A building constructed with prefabricated components according to claim 11 wherein several of said roof truss structures have said knee braces at both ends thereof.

15. A building constructed with prefabricated components according to claim 14 wherein said knee brace of each of said roof truss structures extends in V-shape formation out from said roof truss structure with both outer ends of said V-shaped knee brace being connected to a longitudinally extending wooden member connected to said walls of said building constructed with prefabricated components.

16. A building constructed with prefabricated components according to claim 14 wherein each of said knee braces is connected to a longitudinally extending wooden member connected to said walls of said building contructed with prefabricated components and serves to distribute the load forces generated at the ends of the respective said roof truss structures into such longitudinally extending wooden members and joints where said knee braces are connected to such longitudinally extending wooden members so that said roof truss structures and corresponding longitudinally extending wooden members are capable of withstanding greater loads.

17. A prefabricated braced frame structure comprising:

two longiduinal wooden members;

a plurality of lateral wooden members connected to and between said longitudinal wooden members;

a built-in wooden cross-bracing member extending in between said lateral wooden members and providing support to said lateral wooden members against compressive loads; and a plurality of metal connector plates having teeth struck out for such plates and embedded into said wooden members for interconnecting all of said wooden members for forming a unitary prefabricated structure, said wooden cross-bracing member in said braced frame structure being constructed so as to be formed by a series of wooden sections extending between said lateral members with the ends of said wooden sections abutting the sides of the respective adjacent said lateral members and each of said wooden sections being interconnected with adjacent wooden sections and respective said lateral members by said metal connector plates so that said wooden sections form said cross-bracing member extending between said longitudinal members with each of said wooden sections having one of its sides lying substantially within the same plane as a side of said lateral members so as to provide said braced frame structure with a flat outer surface.

18. A prefabricated braced frame structure according to claim 17 wherein there are two said cross-bracing members built into said braced frame structure and said two cross-bracing members extend in different directions for rigidly securing said braced frame structure against movement in the lateral and longitudinal directions.

19. A prefabricated braced frame structure according to claim 18 wherein said two cross-bracing members include a first cross-bracing member extending from a top end of a first of said longitudinal members to the middle section of a second of said longitudinal members and a second cross-bracing member extending from said middle section of said second longitudinal member to the bottom end of said first longitudinal member.

20. A prefabricated braced frame structure according to claim 19 wherein said two cross-bracing members are interconnected to each other and said second longitudinal member by one of said metal connector plates.

21. A prefabricated braced frame structure according to claim 17 wherein said wooden sections of said cross-bracing member have the same cross-sectional dimensions as said lateral and longitudinal wooden members and said wooden sections and wooden members are arranged edgewise with their narrow sides lying in the same planes.

22. A prefabricated braced purlin structure comprising:

two longitudinal wooden members;

a plurality of lateral wooden members connected to and between said longitudinal wooden members;

a built-in wooden cross-bracing member extending in between said lateral wooden members and providing support to said lateral wooden member against buckling due to compressive loads; and, a plurality of metal connector plates having teeth struck out from such plates and embedded into said wooden members for interconnecting all of the adjacent said wooden members for forming a unitary prefabricated structure, said wooden cross-bracing member in said purlin structure being constructed so as to be formed by a series of wooden sections exending between said lateral members with the ends of said wooden sections abutting the sides of the respective adjacent said lateral members and each of said wooden sections being interconnected with adjacent wooden sections and respective said lateral members by metal connector plates so that said wooden sections form said cross-bracing member extending between said longitudinal members with each of said wooden sections having one of its sides lying in substantially the same plane as a side of said lateral members so as to provide said purlin structure with a flat outer surface.

23. A prefabricated braced purlin structure according to claim 22 wherein there are two said cross-bracing members built into each of said purlin frame structure and said two cross-bracing members extend in different directions for rigidly securing said braced purlin structure against movement in the lateral and longitudinal directions.

24. A prefabricated braced purlin structure according to claim 23 wherein said two cross-bracing members include a first cross-bracing member extending from a top end of a first of said longitudinal members to the middle section of a second of said longitudinal members and a second cross-bracing member extending from said middle section of said second longitudinal member to the bottom end of said first longitudinal member.

25. A prefabricated braced purlin structure according to claim 24 wherein said two cross-bracing members are interconnected to each other and said second longitudinal member by one of said metal connector plates.

26. A prefabricated braced purlin structure according to claim 22 wherein said wooden sections of said cross-bracing member have the same cross-sectional dimensions as said lateral and longitudinal wooden members and said wooden sections and wooden members are arranged edgewise with their narow sides lying in the same planes.

27. A prefabricated roof truss structure comprising:

a bottom chord wooden member;

two top chord wooden members extending at an angle with respect to said bottom chord member and said top chord members being connected to each other and coupled to said bottom chord member;

a plurality of wooden web members interconnecting said top chord members with said bottom chord member;

an integral wooden knee brace structure at at least one end of said roof truss structure connecting the adjacent said top chord member with said bottom chord member and serving as a structure for transferring the loads of said roof truss structure to a longitudinally extending column support member, said knee brace including a vertical brace member having an upper end thereof attached to the adjacent top chord member and a pair of leg members which extend out from an apex to resepctive bearing points on said vertical brace member; and, a plurality of metal connector plates having teeth struck out from such plates and embedded into said wooden members for interconnecting all of the adjacent said wooden members for forming a unitary prefabricated structure, further including a longitudinal vertical column support having a pair of clamping members which define the shape of said knee brace including the vertical brace member and leg members, on either side thereof so that said knee brace fits between said clamping members, and means for securing said knee brace in a fixed position between said clamping members.

28. A prefabricated roof truss structure according to claim 27 wherein said knee brace of said roof truss structure extends in a V-shape formation out from said roof truss structure with both outer ends of said V-shaped knee brace being connected to a longitudinally extending wooden member connected to the walls of a building.

29. A prefabricated roof truss structure according to claim 27 wherein said knee brace is connected to a longitudinally extending wooden member and serves to distribute the load forces generated at the ends of the respective said roof truss structures into such longitudinally extending wooden members and joints where said knee braces are connected to such longitudinally extending wooden members so that said roof truss structures and corresponding longitudinally extending wooden members are capable of withstanding greater loads.

30. A prefabricated roof truss structure according to claim 27 wherein said roof truss structure has said knee braces at both ends thereof.

31. A prefabricated roof truss structure according to claim 30 wherein said knee braces of said roof truss structure extend in a V-shape formation out from said roof truss structure with both outer ends of said V-shaped knee braces being connected to longitudinally extending wooden members connected to the walls of a building.

32. A prefabricated roof truss structure according to claim 30 wherein each of said knee braces is connected to a longitudinally extending wooden member and serves to distribute the load forces generated at the ends of the respective said roof truss structures into such longitudinally extending wooden members and joints where said knee braces are connected to such longitudinally extending wooden members so that said roof truss structures and corresponding longitudinally extending wooden members are capable of withstanding greater loads.

33. A building constructed with prefabricated components comprising:

front, back and side wall structures;

a plurality of prefabricated braced frame structures used in forming at least portions of said walls of said building constructed with prefabricated components, each of said braced frame structures having a series of lateral wooden frame members interconnecting two longitudinal wooden frame members and a built-in wooden frame cross-bracing member extending in between said lateral wooden frame members and means for inteconnecting said wooden members;

a plurality of prefabricated roof truss structures arranged on top of said walls and being approximately equally spaced from each other, said roof truss structures including top chord members; and a plurality of prefabricated purlin structures arranged between and connected to said roof truss structures in approximately the same elevational plane as adjacent ones of said top chord members, with at least several of said purlin frame structures having a plurality of lateral wooden purlin members interconnecting two longitudinal wooden purlin members and a built-in purlin cross-bracing member extending in between said lateral wooden purlin members, and means for interconnecting said wooden members.

34. A prefabricated roof truss structure comprising;

a bottom chord wooden member;

two top chord wooden members extending at an angle with respect to said bottom chord member and said top chord members being connected to each other and coupled to said bottom chord member;

a plurality of wooden web members interconnecting said top chord members with said bottom chord member;

an integral wooden knee brace structure at one end of said roof truss structure connecting the adjacent said top chord member with said bottom chord member and serving as a structure for transferring the loads of said roof truss structure to a longitudinally extending column support member said knee brace including a vertical brace member having an upper end thereof attached to the adjacent top chord member and a pair of leg members which extend out from an apex to respective bearing points on said vertical brace member;

means for interconnecting all of the adjacent said wooden members for forming a unitary prefabricated structure; and further including a longitudinal vertical column support having a clamping member which defines the shape of said knee brace including the vertical brace member and leg members, so that said knee brace fits against said clamping member, and means for securing said knee brace in a fixed position against said clamping member.

* * * * *